United States Patent [19]

Pham Van

[11] 4,286,301

[45] Aug. 25, 1981

[54] H.V. CURRENT CUT-OUT CIRCUIT

[75] Inventor: Doan Pham Van, Meyzieu, France

[73] Assignee: Delle-Alsthom, Villeurbanne, France

[21] Appl. No.: 84,322

[22] Filed: Oct. 12, 1979

[30] Foreign Application Priority Data

Oct. 12, 1978 [FR] France ..... 78 29145

[51] Int. Cl.[3] ..... H01H 33/59

[52] U.S. Cl. ..... 361/3; 361/55

[58] Field of Search ..... 361/3–9, 361/14, 54, 55–57

[56] References Cited

U.S. PATENT DOCUMENTS

| | | | |
|---|---|---|---|
| 3,214,639 | 10/1965 | Carbanes et al. . | |
| 3,476,978 | 11/1969 | Greenwood | 361/4 |
| 3,489,951 | 1/1970 | Greenwood et al. | 361/5 X |

FOREIGN PATENT DOCUMENTS

| | | |
|---|---|---|
| 2010687 | 9/1971 | Fed. Rep. of Germany . |
| 2259431 | 1/1975 | France . |
| 327479 | 1/1958 | Switzerland . |

*Primary Examiner*—Harry E. Moose, Jr.

*Attorney, Agent, or Firm*—Sughrue, Rothwell, Mion, Zinn and Macpeak

[57] ABSTRACT

The invention relates to a current cut-out circuit for a high-voltage electric installation, a current source being located on an input side and an earth fault possibly occurring on its output side. The circuit is characterized in that between the input and the output, it includes for each phase, in series, a cut-out device (1) with a high arcing voltage, said device opening very rapidly, and a circuit-breaker (2) which opens rapidly and, shunt-connected between the input of the cut-out device with a high arcing voltage and earth, a resistance (4) for limiting an earthing current which passes via an automatic cut-out (3) with a very short closing time and a short opening time. Structure (5) is provided for performing the sequence of following operations in a time shorter than half a period: closing the automatic cut-out, opening the high arcing voltage device, opening the rapid-opening circuit-breaker and the automatic cut-out, and, when the current passes through zero, cutting out the high arcing voltage device, the rapid-opening circuit-breaker and the automatic cut-out. The invention applies to protecting switchgear.

8 Claims, 6 Drawing Figures

H.V. CURRENT CUT-OUT CIRCUIT

FIELD OF THE INVENTION

The invention relates to a current-limiting device for cutting out short-circuit currents in high-voltage grids.

BACKGROUND OF THE INVENTION

Due to the constant increase in power of high-voltage electric grids, it is often observed that in some cut-out units, fault currents can rapidly exceed the cut-out or holding capacities of their equipment.

To prevent this, known solutions which immediately come to mind consist in:

- using new equipment which has higher cut-out and holding capacity, which leads to old equipment being replaced by expensive new equipment;
- dividing up the sets of bus bars, opening the lines, cutting up the grid into sub units so as to reduce the short-circuit current to an acceptable level—a solution which users dislike, since their systems no longer operate in optimum conditions; and
- using series impedances; this solution leads to extra constraints during transients for circuit-breakers and to voltage regulation problems requiring bulky equipment and entailing loss.

The required solution is a device which allows the short-circuit current to be reduced very rapidly to a predetermined level and which then allows the initial operating conditions to be re-established once the fault has been corrected.

Such a device must meet the following requirements:

- have an extremely rapid operation time, of about two to three milliseconds;
- be able to limit the peak of the first large asymmetrical wave to a level compatible with the short-circuit holding capacity of the equipment;
- by inserting an impedance in the circuit, reduce the initial short-circuit current to a level which allows cutting out by existing conventional circuit-breakers which have insufficient cutting-out power; and
- have a sufficiently high rated current.

The means which can be used for high voltage are based on the following principles:

- interruption of the short-circuit current before its peak in a vacuum chamber by cancelling the magnetic field which is necessary for the movement of electrons in the arc column, the current then transiting via a resistor which allows the current to be reduced to a predetermined level,
- rapid cancellation of the current by injecting a large high-frequency current in the reverse direction, the device being able to cut out the current at the first artificial zero crossing before the first peak of the asymmetrical wave; and
- very energetic quenching by generating in a very short time an arcing voltage greater than the grid voltage, the arcing voltage reducing the amplitude of the short-circuit current and forcing it to pass through zero.

With very high currents at high voltages, these principles come up against problems which are difficult to solve to meet the above requirements simultaneously.

The invention aims to provide a device which makes it possible to meet these requirements simultaneously.

SUMMARY OF THE INVENTION

The invention provides a high-voltage cut-out circuit for an electric installation, a current source being installed on the input side of the circuit and an earth fault possibly occurring on its output side. It is characterized in that between the input and the output, it includes, for each phase, in series, a cut-out device with a high arcing voltage, said device opening very rapidly, and a circuit-breaker which opens rapidly and, shunt-connected between the input of the cut-out device with a high arcing voltage and earth, a resistance for limiting an earthing current which passes via an automatic cut-out with a very short closing time and a short opening time. Means are provided for performing the sequence of following operations in a time shorter than half a period: closing the automatic cut-out, opening the high arcing voltage device, opening the rapid-opening circuit-breaker and the automatic cut-out, and, when the current passes through zero, cutting out the high arcing voltage device, the rapid-opening circuit-breaker and the automatic cut-out.

Preferably, the automatic cut-out is a static device. According to one embodiment, the automatic cut-out includes, inside a sealed chamber, a main circuit in a pressurized dielectric gas atmosphere. The circuit includes a first main electrode whose cross-section is circular and which is placed in the field of a winding and a second main electrode disposed facing said main electrode, the second main electrode being equipped with an electric arc generator for generating an arc between said main electrodes. The second main electrode can be of revolution, e.g. spherical and its side wall can have an opening behind which two auxiliary ignition electrodes can be disposed in a plane perpendicular to the axis of the winding. The auxiliary electrodes ignite an arc subjected to the action of a magnetic field which moves the arc outwards between said second electrode and said first main electrode, said winding then allowing a current to pass through it rotating said arc.

The sealed chamber of the automatic cut-out can contain a pressurized gas such a sulphur hexafluoride or a mixture of 50% sulphur hexafluoride and 50% nitrogen.

The value of a current limiting resistor for limiting an earthing current lies between 80% and 125% of the value of the minimum impedance of the supply system of the electric installation.

In another arrangement, a second, identical, resistance is disposed symmetrically to that of said current-limiting resistance shunt connected between the other side of the high arcing resistance cut-out device and the automatic cut-out.

BRIEF DESCRIPTION OF THE DRAWINGS

The characteristics and advantages of the invention will become apparent from the description of an embodiment given hereinafter and illustrated in the drawings.

DESCRIPTION OF THE PREFERRED EMBODIMENT

Figure 1:
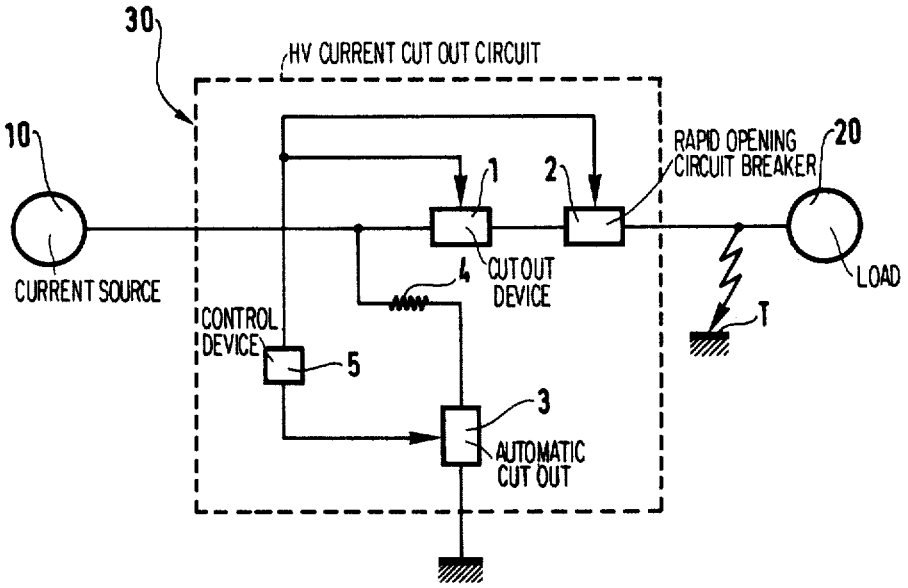
FIG. 1 is a circuit diagram which illustrates schematically an installation which includes a high-voltage cut-out circuit in accordance with the invention.

In FIG. 1, reference 30 designates the HV current cut-out circuit of an electric installation which includes a current source 10 on its input side and a load 20 on its output side. The cut-out circuit includes, from its input to its output, a cut-out device 1 in series with a circuit-breaker 2 and a resistance 4 and an automatic cut-out 3 in parallel between the input of the cut-out device 1 and earth.

The arcing voltage of the cut-out device 1 is high, e.g. a quarter of the grid voltage, or several tens of kilovolts. It has a very short opening time, of about 1.5 milliseconds. This cut-out chamber, which does not have to withstand permanently the stresses of a conventional circuit-breaker, does not need to be provided with the ability to close a circuit as will be seen hereinafter.

The rapid-opening circuit-breaker 2 whose opening time is about a quarter of a period, must cut out the current at the first zero passage, isolate the circuit and be able to close on a fault. All these characteristics are required of conventional rapid circuit-breakers.

The automatic cut-out 3 momentarily earths the grid via a current-limiting resistance 4. It must have the following characteristics: very rapid closing time, i.e. about 1 millisecond, followed by a rapid opening time, i.e. about a quarter of a period. The value of the resistance 4 is low and is of the same order of magnitude as the impedance of the short-circuit of the installation. When an asymmetric T earth fault appears on the output side of the installation, the high arcing voltage cut-out device 1, the rapid-opening circuit-breaker 2 and the automatic cut-out 3 are controlled by operation instructions from a control device 5.

The circuit then operates as follows, with reference to FIG. 2, in which the current i is plotted along the Y-axis and time t is plotted along the X-axis. The instant at which a fault as observed by a known current-detector, (not shown) is designated by reference a and at the instant b, causes the cut-out device 1, the circuit-breaker 2 and the automatic cut-out 3 to operate under the control of the control device 5. Due to the characteristics of these devices, the following sequence of operations ensues. At the instant c, the automatic cut-out 3 closes, thus earthing the grid via the resistance 4. The fault current is subdivided into two parts, one of which continues to flow to earth via the cut-out device 1, the circuit-breaker 2 and the T fault path, while the other flows via the resistance 4. At the instant d, the high-arcing voltage cut-out device opens and as it opens, while the arcing voltage increases, the part of the current which passes through the resistance 4 increases, while the other part decreases. At the instant e, the circuit-breaker 2 opens, then the arc is quenched in the cut-out device 1 and in the circuit-breaker 2 at the instant f when the current passes through zero. As for the automatic cut-out, it cuts out the current which passes via the resistance 4, said current being represented by curve 23 at the instant g of the zero passage.

The curve 21 is therefore a graph of the fault current T when the cut-out circuit 30 is included while the curve 22 in dashed lines is a graph of the fault current when the cut-out circuit is omitted.

The value of the resistance 4 must not be high. To facilitate switching of the fault current, the resistance value is chosen close to that of the input reactance. This corresponds to a power factor close to 0.7. The fault current is then limited to a value which hardly exceeds half the value of the current peak which it would have if the circuit was omitted, as seen on comparing the curves 21 and 22.

When the fault current is cut-out, the sequence of operations is completed by the cut-out device 1 closing which therefore needs no closing power and possibly by the circuit-breaker 2 reclosing. This leads to preparation for a further operation sequence of the cut-out circuit if the T fault is still observed.

The efficiency of the cut-out circuit depends on a high-performance automatic cut-out which, for example, when the grid voltage is 138 kilo-volts, must maintain, between its terminals, an impulse test voltage with a peak of 650 kilovolts, close its contacts in less than a millisecond and cut out the current in a quarter of a period.

Figure 3:
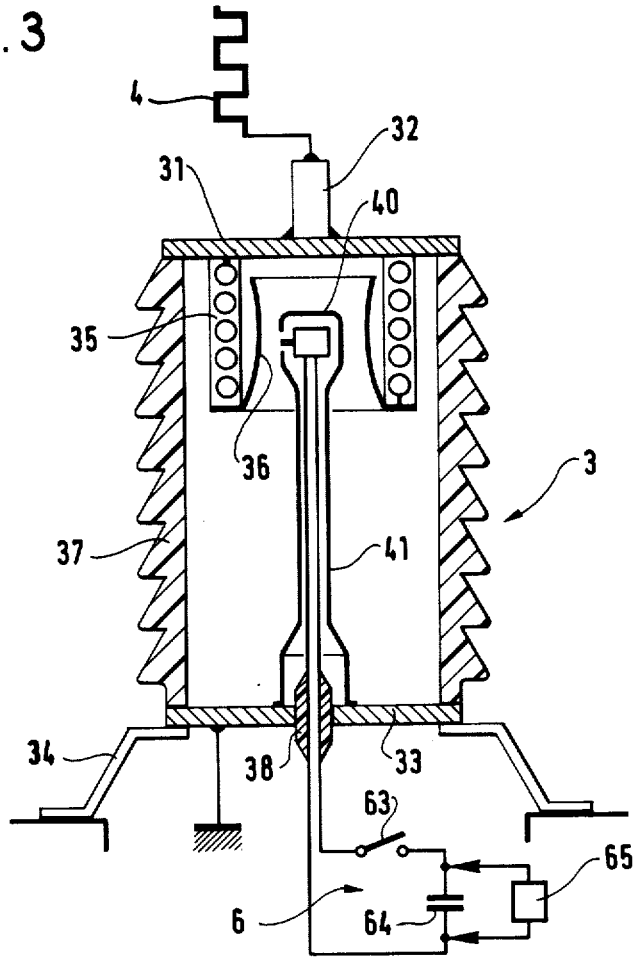
FIG. 3 is a schematic cross-section of one embodiment of an automatic cut-out.
Figure 4:
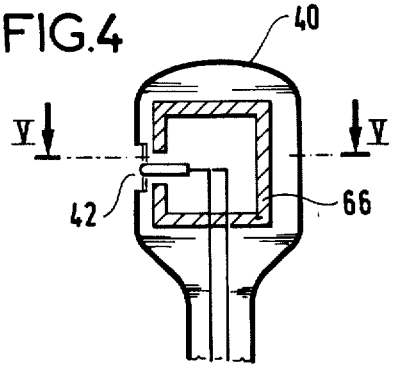
FIG. 4 is an enlarged schematic cross-section of the spherical electrode illustrated in FIG. 3.
Figure 5:
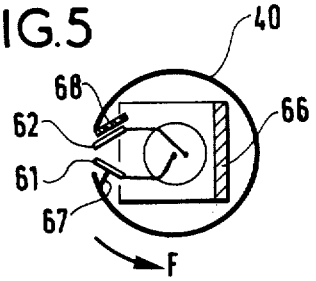
FIG. 5 is a schematic cross-section along line V—V of the spherical electrode of FIG. 4.

For this purpose, the automatic cut-out 3 can advantageously be formed by means of the static device illustrated in FIGS. 3 to 5.

The automatic cut-out 3 is constituted by a cylindrical insulating chamber 37 whose upper portion is closed by a conductive cover 31 which carries a connection terminal 32 connected to the resistance 4 and whose lower portion is closed by the conductive cover 33 connected to earth and supported by legs 34. An insulated winding 35 which is mechanically very strong and is capable of withstanding the earth current limited by the resistance 4 is fixed to the underside of the cover 31. The upper end of the winding is electrically connected to the cover 31, while the lower end is connected to cylindrical or cylindro-conical electrode 36 disposed concentrically in the winding 35.

A spherical or cylindro-conical electrode 40, which is disposed inside the electrode 36 and is supported by a conductive tube 41 connected to the bottom 33 has a side opening 42 facing the electrode 36. Two ignition electrodes 61 and 62 are disposed inside the sphere and facing the opening 42. The electrodes 61 and 62 form part of an arc generator which is designated as a whole by reference 6 and which is illustrated in detail in FIGS. 4 and 5. The ignition electrodes 61 and 62 are connected by conductors disposed inside the tube 41 and an insulating through bushing 38 of the cover 33 to an ultra-rapid control contact 63 which operates in about 0.1 milliseconds, formed, for example, by a thyristor. It controls the circuit of an arc generator which generates arcs by known means such as the discharge of a capacitor 64 driven by a device 65. The ignition electrodes are disposed in the air gap of a permanent magnet 66 or even of a magnetic circuit with an equivalent winding. Further, the electrode 61 is connected by a connection 67 to the sphere 40, while the electrode 62 is insulated therefrom by an insulating screen 68. The insulating chamber 37 contains a sulphur hexafluoride atmosphere or even an atmosphere consisting of a 50% sulphur hexafluoride and 50% nitrogen mixture.

The automatic cut-out 3 is caused to operate as follows. A signal emitted by the control device 5 makes the contact 63 close and makes the capacitor 64 discharge and the capacitor generates an arc between the ignition electrodes 61 and 62.

Since the arc thus generated is subjected to the magnetic field of the magnet 66 which is placed inside the spherical electrode 40, it is projected out through the opening 42 and develops in a plane perpendicular to the winding 35 to reach the electrode 36 while the magnet 66 is protected against the effect of the field of the winding by the electrode 40. Then, the electrodes 36 and 40 are electrically connected together and allow the current to shunt to earth via current-limiting resistance 4. It will be observed that while the fault lasts, before the automatic cut-out 3 operates, the difference in voltage between the electrodes 36 and 40 is small, since the electrode 36 is earthed by the grid fault.

The arc which bridges the gap between the electrodes 36 and 40 in a plane perpendicular to the axis of the winding 35 is subjected to the action of the field of said winding through which the same current flows.

The direction of winding of the winding 35 is such that the arc which comes from the electrode 62 turns in the direction of the arrow F in accordance with Ampere's law. The arc which is subjected to a rapid rotating movement which allows its points of origin to be cooled on the electrodes is extinguished the first time the current passes through zero. A voltage is then re-established between the electrodes 36 and 40 in a circuit whose power factor is substantially equal to 0.7.

The cut-out circuit which has just been described can readily be used to protect an installation which is constituted by a large grid switchgear unit in which, when there is no fault, there is not necessarily a current source side and a load side, since power can be transited in all directions.

Figure 6:
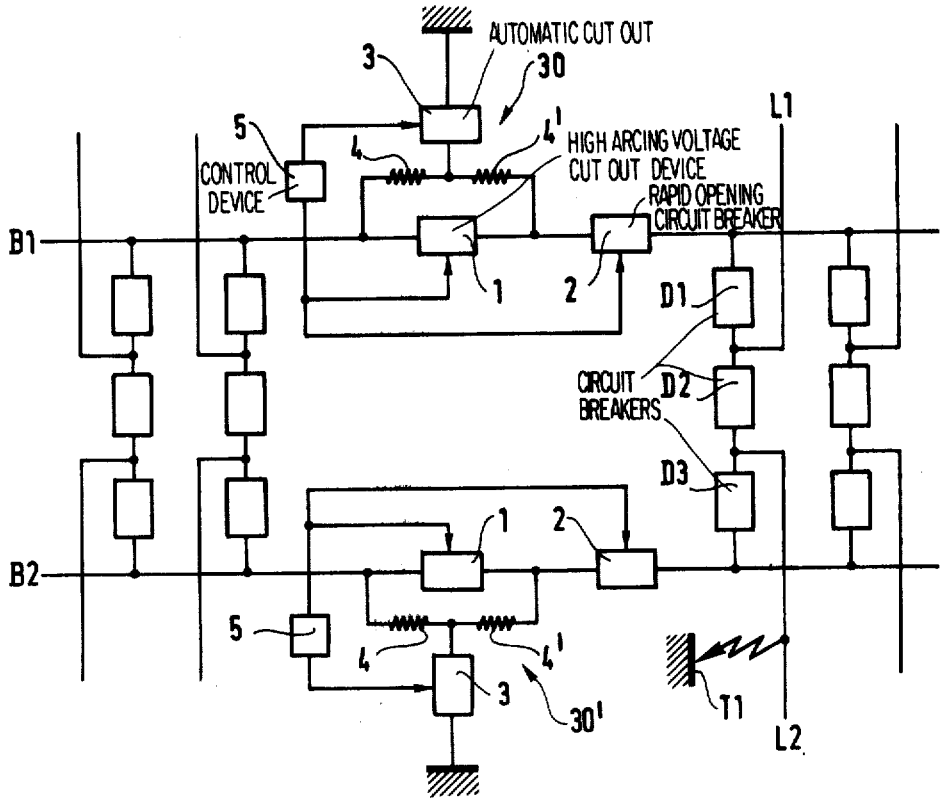
FIG. 6 is a schematic circuit diagram illustration of an electric installation with switchgear equipped with cut-out circuits in accordance with the invention.

FIG. 6 illustrates schematically an example of a unit of the type here called "one and a half circuit-breakers", i.e. a unit which includes three circuit-breakers disposed in series between two sets of bus bars for feeding two outputs which are parallel-connected between two of these circuit-breakers.

The unit therefore includes two sets of bus bars B1 and B2 connected together by several arrangements of three circuit-breakers such as D1, D2 and D3, disposed in series and two branch lines L1 and L2 connected to the terminals of the middle circuit-breaker D2.

Each set of bus bars B1 and B2 is separated in two, preferably at the electric power switching centre, by cut-out circuits 30 and 30' which each comprise a high arcing voltage cut-out device 1 in series with a rapid circuit-breaker 2 and an automatic cut-out 3 in parallel to earth. However, since in the present case, a fault current can occur on either side of the circuit, it is necessary to install two circuits symmetrically side by side. However, it is preferable to be able to shunt the other side of the high arcing voltage cut-out device 1 of a single device by including a second current-limiting resistance 4' identical to the first resistance 4, the two resistances then forming a symmetrical configuration and the resistance 4' being connected between firstly the point common to the high arcing voltage cut-out device and to the rapid-opening circuit-breaker and secondly to the automatic cut-out 3.

When a fault occurs, each device operates like that in FIG. 1. Indeed, a fault which occurs, for example, a T1 on line L2 is fed concurrently by the set of bus bars B1 via the circuit-breakers D1 and D2 and by the set of bus bars B2 via the circuit-breaker D3.

When each automatic cut-out 3 is closed by the control device 5, the current in each of them is divided into three parts: the first passes via the set of bus bars B1 (or B2), the resistor 4 and the automatic cut-out 3; the second passes via the set of bus bars, the resistor 4' and the automatic cut-out 3; and the third passes via the set of bus bars and the circuit and the fault T1.

The resistances 4 and 4' have substantially equal values and are in parallel. Initially, they perform the function of half-value resistances. In the case of the unit illustrated in FIG. 6, which includes two sets of bus bars with a limiter device installed on each set of bars at the electric power distribution centre, the value of each of these resistances can lie between 160 and 250% of the minimum value the short-circuit impedance of the grid which supplies the installation.

Figure 2:
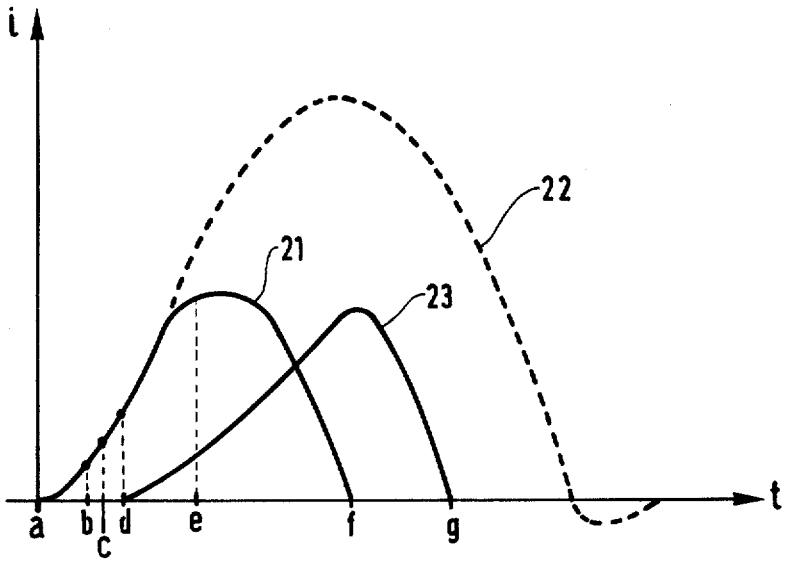
FIG. 2 is a graph of short-circuit currents of the installation illustrated in FIG. 1.

As the arcing voltage rises in the high arcing voltage cut-out device 1, the current increases in the resistance 4, decreases very rapidly in the resistance 4' which is in parallel with the resistance where there is a fault and very rapidly the conditions observed are practically those of FIG. 2.

The sequence of operations is therefore completed by closing the high arching voltage cut-out devices, opening the circuit-breakers D2 and D3 which have to cut out only a low current, thus cutting out the faulty part of the system, then by closing the rapid-opening circuit-breakers which than feed the non-faulty outgoing lines with current from the grid as a whole, as before the fault occurred at T1.

It is then possible to close the circuit-breakers D2 and D3. However, if there is still a fault at T1, the process begins again with the previously described current-limiting devices.

In the case of two-phase or three-phase earth faults, in a system with a neutral wire directly connected to earth, the device of the invention operates simultaneously on the faulty phases.

Such cut-out circuits can also be used in the case of two-phase or three-phase faults isolated from earth.

When the neutral wire of the system is isolated, the earth current has a low amplitude. Therefore, it is not detrimental to the cut-out and overcurrent characteristics of the device and of the installations; in contrast, currents are high in the case of polyphase faults and the circuit of the invention is applicable, the control device 5 sending instructions to the cut-out devices which are placed on the faulty phases.

For all these multiple faults, the shunted currents flow between the phase-limiting resistances.

It is obvious that the invention is in no way limited to the embodiment which has just been described and illustrated and which has been given only by way of example; in particular, without going beyond the scope of the invention, some dispositions can be modified or some means can be replaced by equivalent means or, even, some components can be replaced by others which can perform the same technical function or an equivalent technical function.

Thus, when using very high voltage equipment, it can be necessary to connect several automatic cut-outs in series; in this case, capacitors such as 64 can be isolated from earth and charged separately. Likewise, contacts such as 63 can be simultaneously controlled by an insulated mechanical or electrical system, e.g. a light beam.

I claim:

1. A high-voltage cut-out circuit for an electric installation having an input side and an output side, a current source installed on the input side of the circuit and an earth fault possibly occurring on its output side, the improvement wherein between the input side and the output side, it includes, for each phase, in series, a very rapid opening cut-out device (1) with a high arcing voltage, and a rapid opening circuit-breaker (2) and, shunt-connected between the input of the cut-out device with a high arcing voltage and earth, a resistance (4) for limiting an earthing current and an automatic cut-out (3) with a very short closing time and a short opening time, said circuit further comprising means (5) for performing the sequence of following operations in a time shorter than half a period: closing the automatic cut-out, opening the high arcing voltage device, opening the rapid-opening circuit-breaker and the automatic cut-out, and when the current passes through zero, cutting out the high arcing voltage device, the rapid-opening circuit-breaker and the automatic cut-out.

2. A device according to claim 1, wherein the automatic cut-out (3) is a static device.

3. A device according to claim 2, wherein the automatic cut-out (3) includes, inside a sealed chamber (37), a winding (35), a main circuit in a pressurized dielectric gas atmosphere, said main circuit including a first main electrode (36) whose cross-section is circular and which is placed in the field of said winding (35), a second main electrode (40) disposed facing said main electrode, and wherein said second main electrode is equipped with an electric arc generator (6) for generating an arc between said main electrodes.

4. A device according to claim 3, wherein the second electrode (40) is spherical and that its side wall has an opening (42) behind which two auxiliary ignition electrodes (61, 62) are disposed in a plane perpendicular to the axis of the winding (35), said auxiliary electrodes igniting an arc subjected to the action of a magnetic field which moves the arc outwards between said second electrode and the main electrode (36) and said winding then rotating said arc.

5. A device according to claim 3, wherein the sealed chamber (37) contains a pressurized sulphur hexafluoride atmosphere.

6. A device according to claim 3, wherein the sealed chamber (37) contains a pressurized atmosphere of a mixture of 50% sulphur hexafluoride and 50% nitrogen.

7. A device according to claim 1, wherein the value of said resistance (4, 4') lies between 80% and 125% of the value of the minimum impedance of the supply system of the installation.

8. A device according to claim 7, wherein a second, identical, resistance (4') is disposed symmetrically to that of said current-limiting resistance (4) and is shunt-connected between the other side of the high arcing voltage cut-out device (1) and the automatic cut-out.

* * * * *